United States Patent [19]

Wirz

[11] 4,092,821

[45] June 6, 1978

[54] CONTROL DEVICE FOR AN ELECTRONIC WATCH

[76] Inventor: Carl A. Wirz, Weinbergstrasse 26, 6300 Zug, Switzerland

[21] Appl. No.: 742,457

[22] Filed: Nov. 17, 1976

[30] Foreign Application Priority Data

| | | |
|---|---|---|
| Dec. 2, 1975 | Switzerland | 15615/75 |
| Mar. 2, 1976 | Switzerland | 2542/76 |

[51] Int. Cl.[2] ..... G04C 3/00

[52] U.S. Cl. ..... 58/23 BA; 58/23 R; 58/50 R; 58/85.5

[58] Field of Search ..... 58/23 R, 23 BA, 23 D, 58/50 R, 4 A, 85.5, 55; 200/159 R, 159 A, 246, 248

[56] References Cited

U.S. PATENT DOCUMENTS

| | | | |
|---|---|---|---|
| 3,810,354 | 5/1974 | Naikaido et al. | 58/23 D |
| 3,935,700 | 2/1976 | Van Haaften | 58/4 A |
| 3,973,099 | 8/1976 | Morris | 58/85.5 X |
| 3,974,351 | 8/1976 | Solov et al. | 58/85.5 X |
| 3,978,653 | 9/1976 | Burke et al. | 58/50 R X |
| 3,992,870 | 11/1976 | Dekel | 58/55 X |

*Primary Examiner*—Ulysses Weldon

*Attorney, Agent, or Firm*—Imirie, Smiley & Guay

[57] ABSTRACT

A control device for a battery operated watch including an electronic module including at least one push-button cooperating with at least one leaf spring provided in the watch casing. The leaf spring encircles partially the electronic module and provides the electrical connection between the terminals of the module and the poles of the battery via the push-button and provides the means for limiting the travel of the push-button and resetting the push-button.

8 Claims, 7 Drawing Figures

CONTROL DEVICE FOR AN ELECTRONIC WATCH

BACKGROUND OF THE INVENTION

Known control devices for watches are provided in the form of finished sub-assemblies which are chased or stuck in a hole in the casing. One sub-assembly generally comprises a tube containing an axially displaceable push-button co-operating with a helical spring. With this construction, the travel of the push-button is limited. Present electronic modules have in general very large manufacturing tolerances which as a result, do not always ensure the contact between the push-button and the terminals of the electronic module.

It is the object of the invention to provide a control device which avoids this disadvantage of the prior art.

SUMMARY OF THE INVENTION

According to the present invention there is provided a watch having a casing comprising an electronic module, battery means and control means including at least one push-button co-operating with at least one return spring, said spring being a leaf spring which encircles at least partially said module and simultaneously ensures an electrical connection between at least one terminal of said module and one of the poles of said battery means, the resetting in the rest position of the push-button and the limiting, in at least one direction, of the travel of the push-button.

The manufacture of the control device in accordance with the invention is very economic, omitting several parts which exist in the usual constructions.

BRIEF DESCRIPTION OF THE DRAWINGS

The present invention will be described further, by way of example, with reference to the accompanying drawings, in which.

DETAILED DESCRIPTION

Figure 1:
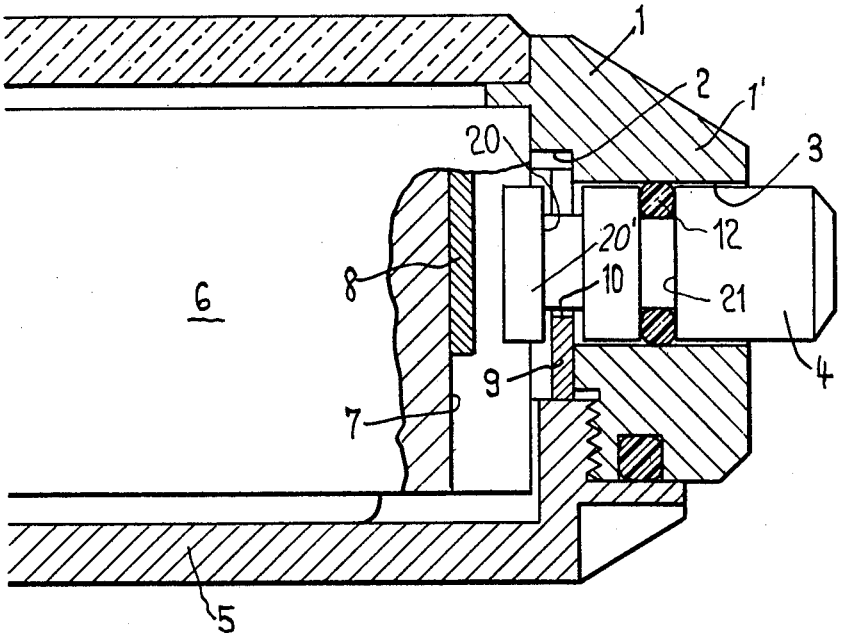
FIG. 1 is a section of part of a casing provided with a control device in accordance with the invention.

FIG. 1 shows a metallic casing 1 including a peripheral wall 1' and defining a chamber closed on one side by a threaded base portion 5. The inner surface of the wall 1' has a recess 2 and a radial bore 3 in communication with recess 2 traverses the wall and permits the insertion of a push-button 4 which is retained in its position of rest by a return spring 9 housed in the recess 2. An electronic module 6, placed inside the chamber has at least one groove 7 in which one or more contact terminals 8 may be provided. The groove 7 is disposed in front of the push-button 4, a plurality of which push-buttons can be provided.

Figure 2:
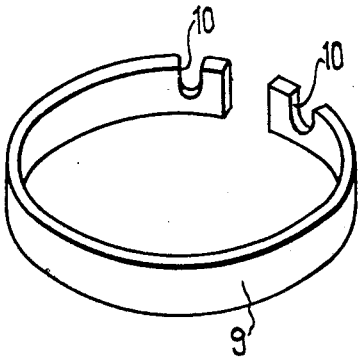
FIG. 2 is a particular embodiment of a return spring.

A control device for a watch comprises a plurality of push-buttons 4 and the return spring 9, which spring 9 (see FIG. 2) is provided in the form of an open ring of elastic material provided with slots or notches 10 in the region of its ends.

The spring 9 with slots 10 therein permits the manufacture of each push-button 4 from a single piece of material in the form of a cylindrical rod which has two annular grooves, a first groove 21 being provided with a watertight sealing member or O-ring 12, and the second groove 20 co-operating with a slot or notch 10 of the spring 9. Obviously, several grooves 21 may be provided having sealing members to improve the watertightness.

The mounting of the control device is extremely simple: the push-buttons 4 provided with members 12 are inserted into the holes 3, then the spring 9 is inserted into the groove 2 so that the slots or notches 10 of the spring 9 engage in the grooves 20 of the push-buttons 4, and the push-buttons 4 are thus retained in position. The electronic module 6 is then inserted in the casing 1, the ends of the push-buttons 4 being situated in one or more grooves 7. The module 6 is thus indexed angularly with respect to the casing 1.

To control a particular function or a correction of the display of the watch, it is sufficient to electrically connect a terminal 8 of the module to the metallic casing, which is in contact with one of the poles of the cell, by pressing the push-button 4. The spring 9, flexible with a low constraint rate (lever arm unequal to the radius of the ring) permits a long displacement of the push-button 4, thus eliminating the problems of tolerances of the manufacture of the module 6.

It is necessary that the return spring 9 be manufactured in a conducting material having suitable elastic properties, (for example Bz-Be)

The spring 9 plays three roles, in that it ensures the electric connection between the module 6 and ground (one of the poles of the battery), and the resetting of the push-button, and defines the travel, at least in one direction, of the push-buttons.

Figure 3:
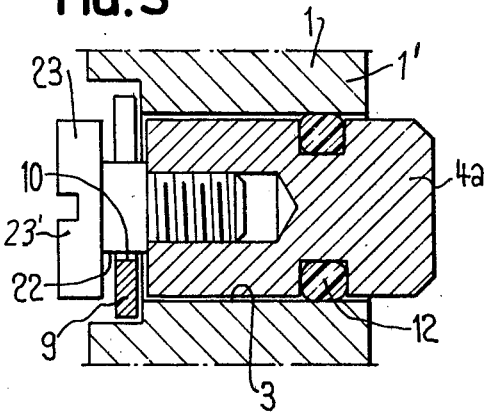
FIG. 3 is a particular embodiment of a push-button.

The push-buttons 4 can be made in two parts (FIG. 3), a cylindrical part 4*a*, provided with a sealing member 12, and a screw 23 with a contact head 23' having a shoulder 22 which engages in slot 10 of the spring 9.

To avoid problems when, for example, the watch is plunged into salt water, the outer parts of the push-buttons 4 or the part 4*a* may be made in plastic material. In this case, the push-button 4 is made with a plastic material outer knob chased onto a metallic part provided with a groove 20 between the button body and a contact head 20'. The knob forms the groove for the sealing member 12 and the part which one presses.

To improve the quality of the electronic contacts between the module and the casing, it is preferable to plate the surface of the terminals 8, the front surface of the push-buttons 4, the groove 20, the region of the slots 10, a part of the recess 2 and the surface of the spring 9 in contact with the casing 1 (in the recess 2).

The spring 9 could be incorporated (FIG. 4) in the electronic module 6 during moulding which provides several advantages. In this case, the synthetic material which encloses the module must be removed over an angle which is sufficient to permit flexing of the ends of the spring 9 on which, as previously described, one or more push-buttons 4 are mounted in slots 10, opposite the terminals 8.

With two opposite cut-out portions, four push-buttons can be mounted, in which case, the spring 9 then comprises two parts, each partially embedded in the module, the ends of which are provided with slots 10.

Figure 4:
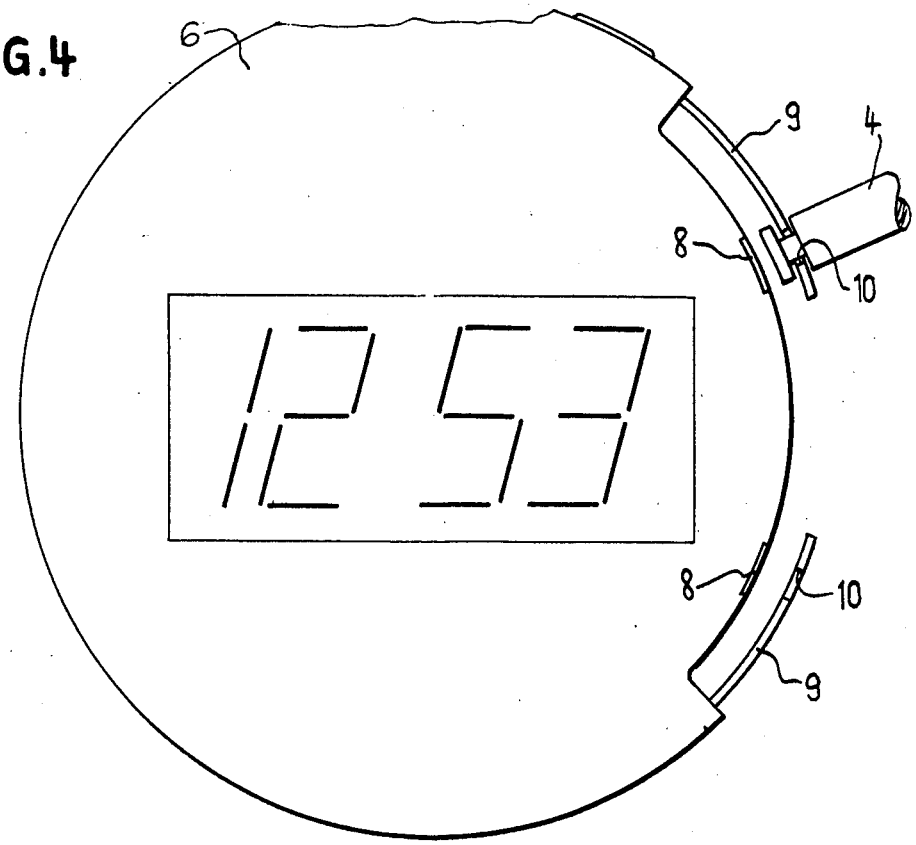
FIG. 4 shows the return spring incorporated with an electronic module.

FIG. 4 shows a cylindrical module 6, but it is clear that the control device can be associated with modules of polygonal or other shape. In the particular case where the module is square, the return spring is formed by two rectilinear springs the ends of which can be folded so that the push-buttons may be actuated in a radial direction with respect to the casing. The springs can be connected to one of the poles of the battery, by a connection inside the module.

Figure 5:
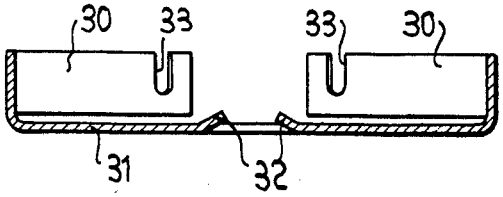
FIG. 5 illustrates an alternative embodiment of the return spring associated with a casing made in insulating material.

In the arrangement of FIG. 1, with a casing of injection moulded plastics material (or other insulating material) it is necessary to electrically connect, via the push-buttons, the terminals of the module and one of the poles of the battery. The springs must then have a shape of the type represented in FIG. 5. The arms 30 are connected to collar or plate 31 having resilient tongues 32 which bear against one of the poles of the battery. The ends of the arms 30 have slots 33. With a casing in plastics material the water-tight mounting of the push-buttons may be omitted, so that these only then have a groove which permits the engagement of the push-buttons with the return spring.

Figure 6:
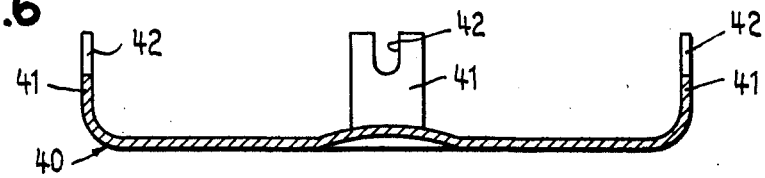
FIGS. 6 and 7 show two other alternative embodiments of the return spring.

As shown in FIG. 6, a spring 40 with vertical arms 41 may be provided having slots 42 which, as previously, hook in the push-buttons. It is possible to image several methods of housing this arrangement, for example:

(A) The arms 41 may be housed in recesses provided in the bore of the casing, with a protruding part of the base bearing against the pole of a battery (plastic material casing);

(B) The spring 40 may be housed in a groove of the electronic module; or (C) The plane part of the spring may comprise an annulus with a bore of a diameter sufficient to allow the passage of a battery, the base of the spring being incorporated with the module during moulding.

Alternatively, the arms 41 may be made by cutting out vertical slits in a flat base capsule (closed or open).

Figure 7:
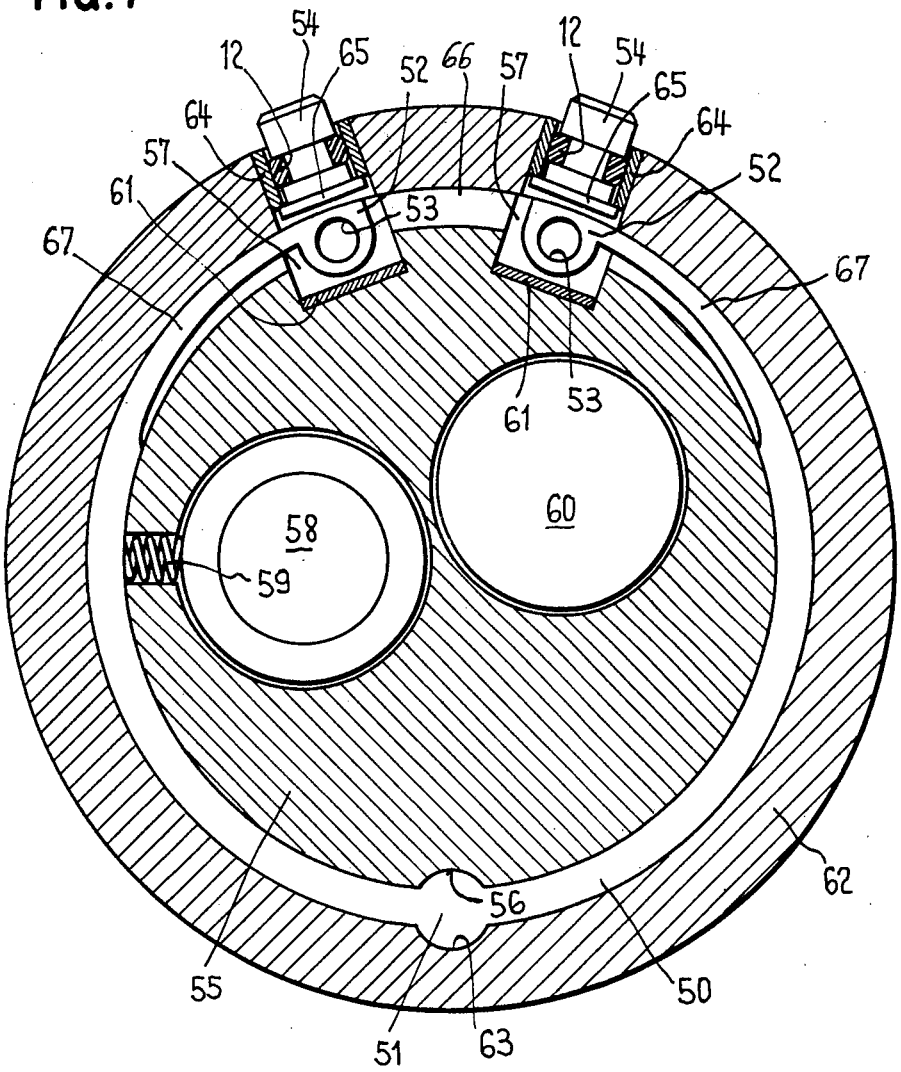

FIG. 7 represents an embodiment which permits the simplification of the machining of the casing. The control device comprises an open elastic annulus 50, of rectangular cross-section, the general form of which resembles a circlip. This annulus 50 has a circular boss 51 located on the axis of symmetry thereof. Each of the ends of the annulus 50 terminates with a boss 52 projecting inwardly towards the centre and including a bore 53. The radial axes of the bores 53 coincide with those of the push-buttons 54. Over a certain length, a reduced portion 67 of the annulus 50 is provided between each boss 52 and the rectangular section of the annulus 50.

The annulus 50 is suitably cut out from a sheet of metal, which has had a appropriate heat treatment to give it the necessary elastic properties. With pliers which engage in the bores 53 the annulus is opened and mounted in a groove 66 provided (during moulding) in the module 55. The boss 51 engages in a corresponding groove 56 of the module 55 which permits the locating of the angular position of the annulus 50 with respect to the recesses 57. The groove 56 can be made in the base of the groove 66 or, to facilitate the positioning of the annulus 50, over the whole of the height of the module 55.

One of the poles of a battery 58 and the annulus 50 are electrically connected by a helical spring 59 (for example), and the batteries 58 and 60 can be connected in series or in parallel, by means not shown. The contacts 61, placed in the base of the recesses 57, are likewise connected by means not shown to a pole of the battery 60.

The module/annulus assembly 55/50 is mounted in the casing 62, and the boss 51 engages in a semi-circular groove 63 which defines the angular position of the assembly with respect to the casing. This groove 63 is machined or moulded over a part of the height of the casing.

Each of the push-buttons 54 is housed in a smooth surfaced socket 64 chased or stuck in a radial bore of the casing 62. Each push-button 54 is composed of a cylindrical part provided with at least one water-tight sealing member 12 and an abutment 65 which normally engages one of the faces of the socket 64.

In the rest position, a push-button 54 remains stationary by reason of the friction of the member 12 against the bore of the socket 64, and during shocks its travel is limited by the end of the annulus 50.

By pressing a push-button 54, the reduced portion 67 of the annulus 50 bends so that the boss 52 touches the contact 61 thus initiating one of the functions of the watch (for example, changing of the date).

The sockets 64, and the casing, can be made in synthetic material or in metal.

In certain special cases the elastic annulus 50 could be located in a groove provided in the casing of the watch, the base of the groove would then be provided with a semicircular groove 63, the groove 66 of the module would be omitted and the groove 56 would be provided over part of the height of the module.

I claim:

1. A watch comprising a casing defining a chamber and including a peripheral wall having at least one through bore and a notch;

battery means in said chamber;

an electronic module in said chamber having at least one notch in its periphery and at least one terminal at its periphery; and control means including at least one push-button in said through bore and radially slidable therein;

a return spring means electrically connected to said battery means cooperating with said push-button and comprising a substantially circular return spring having two opposing ends and substantially encircling said module, said return spring having a middle portion thereof with a substantially rectangular cross-section and comprising, a boss for engaging in said notch of said casing in order to locate said return spring with respect to the casing and also for engaging in said notch of said module in order to locate said module with respect to said return spring, each of the ends of said return spring being terminated with a boss projecting inwardly toward the center of the casing, said end bosses including respective bores usable to facilitate the seizure of the return spring during its assembly in the watch, the radial thickness of the return spring being reduced over a certain length between each of said terminating boss and the rectangular section of said spring in order to create a resilient part of the return spring which, when actuated by the push-button pushed radially inwardly in said through bore of said casing, will move inwardly so that the terminating boss establishes a good electrical contact with the terminal of the module, the resilience of said part of reduced section being sufficient to break such contact and return said push-button to its original rest position.

2. A watch according to claim 1, wherein said peripheral wall has a plurality of bores, said module has a like number of electrical contacts radially aligned with said bores, a plurality of buttons respectively mounted in said bores, said end bosses of said return spring being aligned with contacts and said bores for selective independent engagement by the corresponding said push-button.

3. A watch according to claim 1, wherein said module has an annular groove for receiving said return spring.

4. A watch in accordance with claim 1, in which said return spring and said module form a sub-assembly which is mounted in said casing, said boss of said return spring engaging in a corresponding notch provided on said casing in order to locate said sub-assembly with respect to said casing.

5. A watch in accordance with claim 1, in which said push-button is made of one cylindrical piece of material, said push-button being provided with at least one watertight sealing member and being housed in a smooth surfaced socket in a radial bore of said casing.

6. A watch in accordance with claim 1, wherein said return spring engages radially into a casing groove.

7. A watch in accordance with claim 1, wherein said reduced end portion of said return spring loosely engages between said push-button and said module terminal.

8. A watch according to claim 1 wherein said return spring boss is substantially circular.

* * * * *